US007144610B1

(12) United States Patent
Estes et al.

(10) Patent No.: US 7,144,610 B1
(45) Date of Patent: Dec. 5, 2006

(54) DISPLAY TREE

(76) Inventors: Benjamin Estes, 22000 Nancy Pl., Saugus, CA (US) 91350; William Bingham, 23016 Cheyenne Dr., Valencia, CA (US) 91354

( * ) Notice: Subject to any disclaimer, the term of this patent is extended or adjusted under 35 U.S.C. 154(b) by 378 days.

(21) Appl. No.: 10/713,957

(22) Filed: Nov. 14, 2003

(51) Int. Cl.
*A47G 33/06* (2006.01)

(52) U.S. Cl. ..... 428/19; 428/17; 428/18; 428/27; D11/118; 362/123; 362/568; 362/806; 40/411; 446/73; 211/128.1; 211/129.1; 211/133.4; 211/196; 211/205; 493/956

(58) Field of Classification Search ..... 428/17, 428/18, 19, 27; D11/118; 362/123, 568, 362/806; 40/411; 446/73; 211/196, 205, 211/128.1, 129.1, 133.4; 493/956
See application file for complete search history.

(56) References Cited

U.S. PATENT DOCUMENTS 1,577,207 A 3/1926 Dieperink-Langereis
2,615,583 A 10/1952 Johnson
3,674,612 A 7/1972 Ghel, Jr.
3,752,407 A * 8/1973 Baugh et al. ..... 362/123
D269,771 S 7/1983 Williams
4,748,058 A 5/1988 Craig, Jr.
5,085,901 A 2/1992 Johnson et al.
5,422,801 A * 6/1995 Sangalli, Jr. ..... 362/252
5,735,415 A 4/1998 Wilson
5,776,559 A * 7/1998 Woolford ..... 428/18
D414,056 S * 9/1999 Palm et al. ..... D6/450
6,210,762 B1 4/2001 Pielow
6,677,689 B1 * 1/2004 Marihugh et al. ..... 307/147

* cited by examiner

*Primary Examiner*—Jennifer C. McNeil
*Assistant Examiner*—Aaron Austin

(57) ABSTRACT

A display tree for electrical ornaments has a support tube. A male electrical plug is connected to the support tube upper end. A female electrical socket is connected to the support tube lower end. A flange electrical contact is electrically connected to the female electrical socket. The flange electrical contact is connected to the lower flange. A shelf electrical contact is connected to the shelf bottom side. The shelf electrical contact is for detachable connection to the flange electrical contact. A shelf electrical outlet is connected to the shelf top side. The shelf electrical outlet is electrically connected to the shelf electrical contact.

20 Claims, 3 Drawing Sheets

DISPLAY TREE

BACKGROUND OF THE INVENTION

1. Field of the Invention

The present embodiment of the invention relates to a display tree for use in connection with displays. The display tree has particular utility in connection with display trees having electrical outlets having flanges and recessed shelves.

2. Description of the Prior Art

Display trees are desirable for displaying ceramic works of art. A need was felt for a display tree that had electrical outlets inset into recessed shelves and had flanges allowing the tree to be sturdily built and easily plugged in without external wiring.

The use of displays is known in the prior art. For example, U.S. Pat. No. 3,647,612 to Ghel, Jr. discloses a folding tree-like display stand that includes a plurality of axially aligned rings or disks of graduated diameters, mounted vertically to form a generally conical shape which stylistically suggests a Christmas tree. However, the Ghel, Jr. '612 patent does not have electrical outlets inset into recessed shelves and flanges having electrical plugs allowing the tree to be secured and plugged in without external wiring.

Similarly, U.S. Pat. No. 5,085,901 to Johnson et al. discloses an artificial tree that has a top section, a bottom section and a centrally positioned vertical pole which is height adjustable. The top section has a top member and a plurality of rings with the lower most ring also having a plurality of spokes interconnecting the ring with an inner hub. A plurality of strings depend downwardly from the top member and secure each of the other rings in their desired parallel positions. The bottom section also has a plurality of rings with the upper most and lower most rings having spokes and inner hubs. The rings of the bottom section are also connected together by string. The upper most ring of the bottom section sets atop the height adjustment means. In addition to the pole preferably having two sections telescopically oriented with respect to each other, the tree also is formed with strands of garland and preferably ornaments secured thereto. In an alternative embodiment the tree includes an open space essentially at the vertical midpoint of the tree for use associated with a holiday display. However, the Johnson et al. '901 patent does not have electrical outlets inset into recessed shelves and flanges having electrical plugs allowing the tree to be secured and plugged in without external wiring.

Further, U.S. Pat. No. DES 414,056 to Palm et al. discloses Christmas tree collectable display stand. However, the Palm et al. '056 patent does not have electrical outlets inset into recessed shelves and flanges having electrical plugs allowing the tree to be secured and plugged in without external wiring.

Further still, U.S. Pat. No. 1,577,207 to Dieperink-Langereis discloses an artificial Christmas tree that having ornamental wings, a center post that has grooves which receive the inner edges of the wings. A shelf is located on the post and has removable interlocking engagement with the wings. However, the Dieperink-Langereis '207 patent does not have electrical outlets inset into recessed shelves and flanges having electrical plugs allowing the tree to be secured and plugged in without external wiring.

Further yet, U.S. Pat. No. 2,615,583 to Johnson discloses a display stand that has a base, an upright secured at its lower end to the base. The upright has at least one transverse slot joining its forward surface. The upright also having below the slot an opening projecting from front to rear. A shelf of lesser thickness than the distance between the upper and lower horizontal portions of the upright defining the slot. The shelf projecting forwardly from the upright and having a rear edge portion received within the slot. A bracket located at the forward side of the upright has a top surface extending laterally of the upright below the shelf. A bolt of smaller diameter than the opening passing through the bracket and opening and vertically adjustable relative to the upright and vertically adjustable relative to the upright and a nut cooperating with the bolt for securing the bracket frictionally into engagement with the upright and shelf after the bracket and bolt have been vertically adjusted on the upright. However, the Johnson '583 patent does not have electrical outlets inset into recessed shelves and flanges having electrical plugs allowing the tree to be secured and plugged in without external wiring.

Additionally, U.S. Pat. No. 5,735,415 to Wilson discloses a Christmas tree shelf structure for use with either natural or artificial trees consisting of radially extending shelf supports which are removably mounted upon the tree column or trunk. Three different embodiments of shelf bracket support are shown, and the brackets permit a display shelf to be located within the branches of a Christmas tree to permit the support of tree decorations not otherwise usable with Christmas trees. However, the Wilson '415 patent does not have electrical outlets inset into recessed shelves and flanges having electrical plugs allowing the tree to be secured and plugged in without external wiring.

Yet additionally, U.S. Pat. No. DES269,771 to Williams discloses simulated Christmas tree. However, the Williams '771 patent does not have electrical outlets inset into recessed shelves and flanges having electrical plugs allowing the tree to be secured and plugged in without external wiring.

Yet further additionally, U.S. Pat. No. 4,748,058 to Craig, Jr. discloses an artificial tree assembly, and a tree constructed therefrom, are provided. The assembly comprises a collapsible three-piece pole; a base member formed by the bottom of a box for storing the tree assembly and including a pole support member secured thereto for supporting the pole; and a plurality of limb sections and interconnecting garlands. The limb-sections each comprise a central ring portion and a plurality of limb members extending radially outwardly from the central ring portions. The ring portions of the limb sections are stacked, when not in use, on the pole support member and are disposed, in use, along the length of pole in spaced relationship therealong. The garlands interconnect the limb portions so that as the ring portions are lifted, from the top, from the stacked positions thereof on the pole support member and slid along the pole, the garlands between adjacent limb section are tensioned, in turn, and thus serve to lift the next adjacent limb section until the tree is fully erected. However, the Craig, Jr. '058 patent does not have electrical outlets inset into recessed shelves and flanges having electrical plugs allowing the tree to be secured and plugged in without external wiring.

Lastly, U.S. Pat. No. 6,210,762 to Pielow discloses an ornamental display such as an artificial Christmas tree has a conical hollow body which is externally ornamented and closed by a pair of side-hinged doors. An ornamental scene is housed within the hollow body and is viewable when the doors are open. A sound and/or motion sensor is provided for automatically operating a motor for opening the doors which are spring-biassed into the closed position in which the ornamental scene is hidden from view. However, the Pielow '762 patent does not have electrical outlets inset into recessed shelves and flanges having electrical plugs allowing the tree to be secured and plugged in without external wiring.

While the above-described devices fulfill their respective, particular objectives and requirements, the aforementioned patents do not describe a display tree that allows display trees having electrical outlets having flanges and recessed shelves. The Ghel, Jr. '612, Johnson et al. '901, Palm et al. '056, Johnson '583, Wilson '415, Williams '771, Craig, Jr. '058 and Pielow '762 patents make no provision for electrical outlets inset into recessed shelves and flanges having electrical plugs allowing the tree to be secured and plugged in without external wiring.

Therefore, a need exists for a new and improved display tree, which can be used for display trees having electrical outlets having flanges and recessed shelves. In this regard, the present embodiment of the invention substantially fulfills this need.

In this respect, the display tree according to the present embodiment of the invention substantially departs from the conventional concepts and designs of the prior art, and in doing so provides an apparatus primarily developed for the purpose of display trees having electrical outlets having flanges and recessed shelves.

SUMMARY OF THE INVENTION

In view of the foregoing disadvantages inherent in the known types of displays now present in the prior art, the present embodiment of the invention provides an improved display tree, and overcomes the above-mentioned disadvantages and drawbacks of the prior art. As such, the general purpose of the present embodiment of the invention, which will be described subsequently in greater detail, is to provide a new and improved display tree and method which has all the advantages of the prior art mentioned heretofore and many novel features that result in a display tree which is not anticipated, rendered obvious, suggested, or even implied by the prior art, either alone or in any combination thereof.

To attain this, the present embodiment of the invention essentially comprises a support tube. A male electrical plug is connected to the support tube upper end. A female electrical socket is connected to the support tube lower end. A flange electrical contact is electrically connected to the female electrical socket. The flange electrical contact is connected to the lower flange. A shelf electrical contact is connected to the shelf bottom side. The shelf electrical contact is for detachable connection to the flange electrical contact. A shelf electrical outlet is connected to the shelf top side. The shelf electrical outlet is electrically connected to the shelf electrical contact.

There has thus been outlined, rather broadly, the more important features of the embodiment of the invention in order that the detailed description thereof that follows may be better understood and in order that the present contribution to the art may be better appreciated.

The present embodiment of the invention may also include a base. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved display tree that has all of the advantages of the prior art displays and none of the disadvantages.

It is another object of the present embodiment of the invention to provide a new and improved display tree that may be easily and efficiently manufactured and marketed.

An even further object of the present embodiment of the invention is to provide a new and improved display tree that has a low cost of manufacture with regard to both materials and labor, and which accordingly is then susceptible of low prices of sale to the consuming public, thereby making such display tree economically available to the buying public.

Still another object of the present embodiment of the invention is to provide a new display tree that provides in the apparatuses and methods of the prior art some of the advantages thereof, while simultaneously overcoming some of the disadvantages normally associated therewith.

Even still another object of the present embodiment of the invention is to provide a display tree having electrical outlets having flanges.

Lastly, it is an object of the present embodiment of the invention is to provide a display tree having electrical outlets within recessed shelves.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
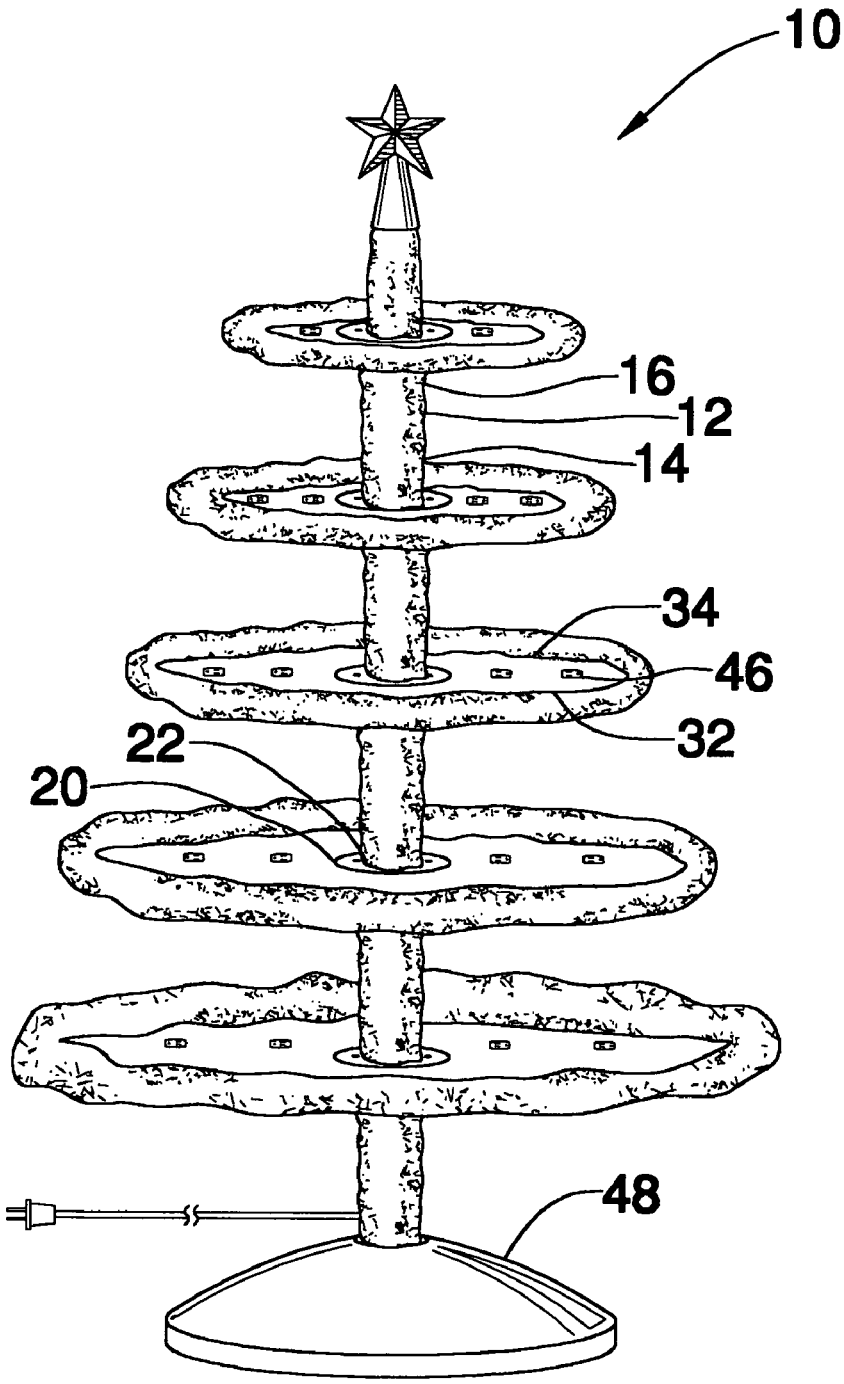
FIG. 1 is a front perspective view of the preferred embodiment of the display tree constructed in accordance with the principles of the present invention.
Figure 2:
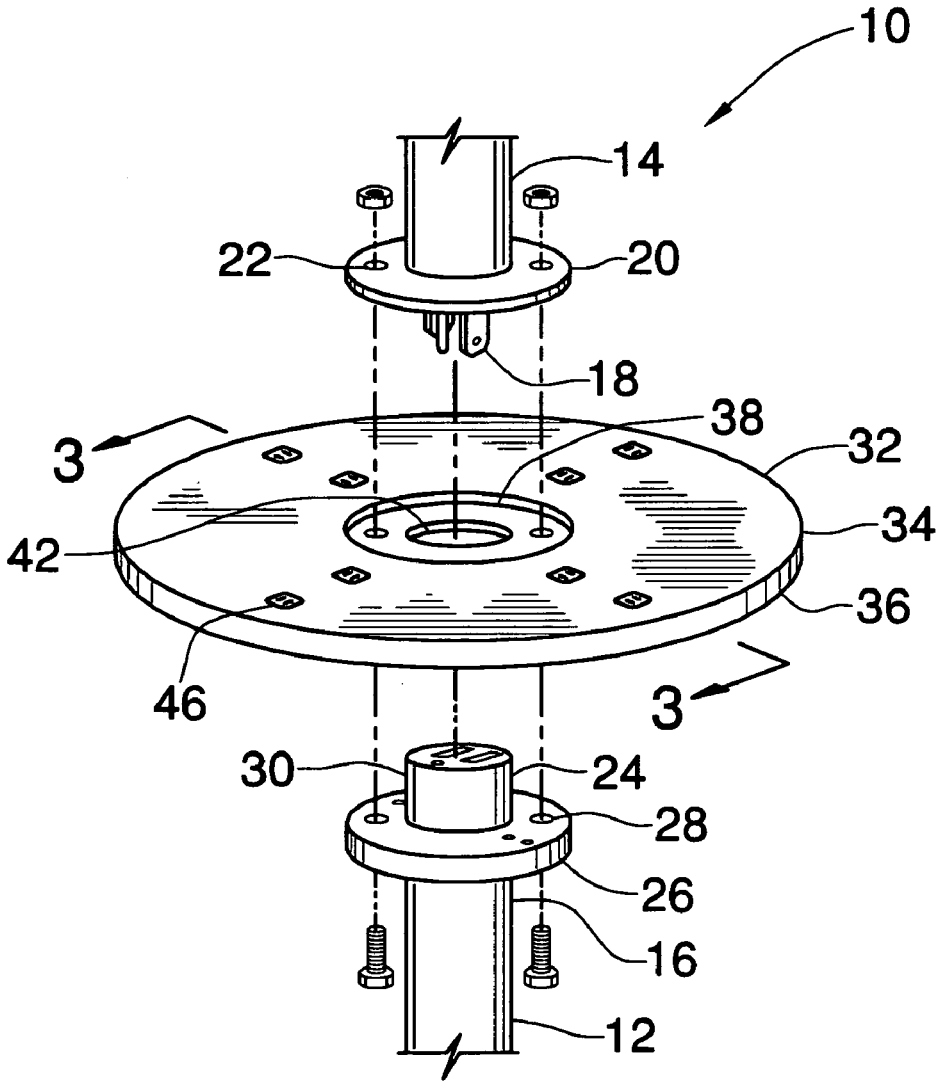
FIG. 2 is a top perspective view of the display tree of the present embodiment of the invention.
Figure 3:
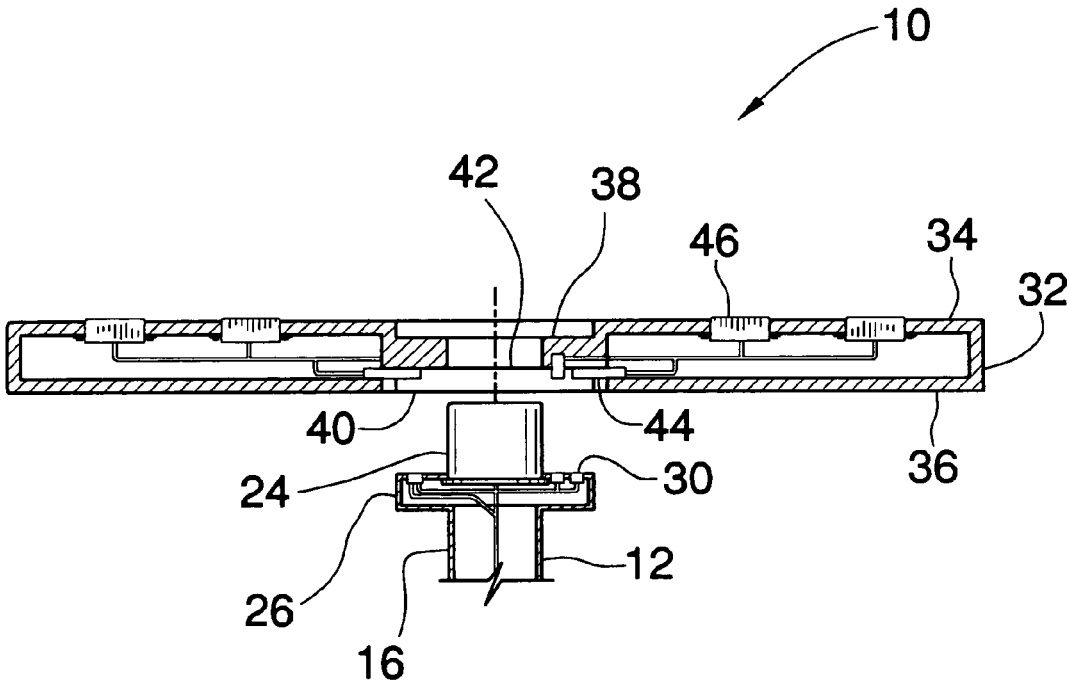
FIG. 3 is a section 3—3 view of FIG. 2 of the display tree of the present embodiment of the invention.

Referring now to the drawings, and particularly to FIGS. 1–3, a preferred embodiment of the display tree of the present invention is shown and generally designated by the reference numeral 10.

In FIG. 1, a new and improved display tree 10 of the present invention for display trees having electrical outlets having flanges and recessed shelves is illustrated and will be described. More particularly, a support tube 12 has two opposite ends, an upper end 14 and a lower end 16. The support tube 12 is comprised of plastic. An upper flange 20 is connected to the support tube 12 adjacent to the support tube upper end 14. The upper flange 20 has an upper flange bolt hole 22 therethrough. A substantially disc-shaped shelf 32 has two opposite sides, a top side 34 and a bottom side 36 (shown in FIG. 3). The shelf 32 is comprised of plastic. In the present embodiment the shelf diameter is between 12 inches and 60 inches in diameter and can be assembled to resemble a Christmas tree. In the present embodiment larger diameter shelves are placed at the bottom and have a smaller diameter from bottom to top. In the present embodiment there are 5 to 6 shelves and the overall tree height is 4 to 8 feet. A shelf electrical outlet 46 is connected to the shelf top side 34. A base 48 is detachably connectable to the support tube upper end 14. As can be seen from FIG. 1 the support tubes 12 and shelves 32 can be assembled into a display area that has the outline of a Christmas tree.

In FIG. 2, the display tree 10 is illustrated and will be described. More particularly, the support tube 12 has two opposite ends, the upper end 14 and the lower end 16. The support tube 12 is comprised of plastic. A male electrical plug 18 is connected to the support tube upper end 14. The upper flange 20 is connected to the support tube 12 adjacent to the support tube upper end 14. The upper flange 20 has the upper flange bolt hole 22 therethrough. A female electrical socket 24 is connected to the support tube lower end 16. A lower flange 26 is connected the support tube 12 adjacent to the support tube lower end 16. The lower flange 26 has a lower flange bolt hole 28 therethrough. A flange electrical contact 30 is electrically connected to the female electrical socket 24. The flange electrical contact 30 is connected to the lower flange 26. The substantially disc-shaped shelf 32 has two opposite sides, the top side 34 and the bottom side 36 (shown in FIG. 3). The shelf top side 34 has a top side recess 38 which is complementary to the upper flange 20. The shelf bottom side 36 has a bottom side recess 40 (shown in FIG. 3) which is complementary to the lower flange 26. The shelf 32 has a hole 42 therethrough. The shelf 32 is comprised of plastic. A shelf electrical contact 44 (shown in FIG. 3) is connected to the shelf bottom side 36. The shelf electrical contact 44 is for detachable connection to the flange electrical contact 30. The shelf electrical contact 44 is located within the shelf bottom side recess 40 to make the shelf electrical contact 44 inaccessible when the shelf 32 is connected to the lower flange 26. The shelf electrical outlet 46 is connected to the shelf top side 34. The shelf electrical outlet 46 is electrically connected to the shelf electrical contact 44. The shelf electrical outlet 46 to shelf electrical contact 44 electrical connection is disposed within the shelf 32.

In FIG. 3, the display tree 10 is illustrated and will be described. More particularly, the support tube 12 has the lower end 16. The female electrical socket 24 is connected to the support tube lower end 16. The lower flange 26 is connected the support tube 12 adjacent to the support tube lower end 16. The flange electrical contact 30 is electrically connected to the female electrical socket 24. The flange electrical contact 30 is connected to the lower flange 26. The substantially disc-shaped shelf 32 has two opposite sides, the top side 34 and the bottom side 36. The shelf top side 34 has the top side recess 38 which is complementary to the upper flange 20 (shown in FIG. 2). The shelf bottom side 36 has the bottom side recess 40 which is complementary to the lower flange 26. The shelf 32 has the hole 42 therethrough. The shelf electrical contact 44 is connected to the shelf bottom side 36. The shelf electrical contact 44 is for detachable connection to the flange electrical contact 30. The shelf electrical contact 44 is located within the shelf bottom side recess 40 to make the shelf electrical contact 44 inaccessible when the shelf 32 is connected to the lower flange 26. The shelf electrical outlet 46 is connected to the shelf top side 34. The shelf electrical outlet 46 is electrically connected to the shelf electrical contact 44. The shelf electrical outlet 46 to shelf electrical contact 44 electrical connection is disposed within the shelf 32, this allows the electrical connection to be completely hidden from view.

In use, it can now be understood that the female electrical socket 24 is placed inside the shelf hole 42 and the male electrical plug 18 is connected to it. The upper flange 20 fits inside the shelf top side recess, the lower flange 26 fits inside the shelf bottom side recess. The upper flange bolt hole is aligned to the lower flange bolt hole and the flanges are bolted together. This allows shelves of different diameters to be fitted together. Objects of art that require electricity can be plugged into the shelf electrical outlet 46 for power.

While a preferred embodiment of the display tree has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as metal or a variety of wood may be used instead of the plastic described. And although display trees having electrical outlets having flanges and recessed shelves have been described, it should be appreciated that the display tree herein described is also suitable for displaying any electrical device.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. A display tree comprising:

a plurality of support tubes having two opposite ends, an upper end and a lower end;

a plurality of male electrical plugs one of said male electrical plugs connected to each of said support tubes' upper end;

a plurality of upper flanges one of said upper flanges connected to each of said support tubes adjacent to said support tubes' upper end;

a plurality of female electrical sockets one of said female electrical sockets connected to each of said support tubes' lower end;

a plurality of lower flanges one of said lower flanges connected to each of said support tubes adjacent to said support tubes' lower end;

a plurality of flange electrical contacts electrically connected to said female electrical sockets, said flange electrical contacts connected to said lower flanges;

a plurality of substantially disc-shaped shelves having two opposite sides, a top side and a bottom side;

a plurality of shelf electrical contacts connected to each of said shelves' bottom side, said shelf electrical contacts for detachable connection to said flange electrical contacts; and a plurality of shelf electrical outlets connected to said shelves' top side, said shelf electrical outlets electrically connected to said shelf electrical contacts.

2. The display tree of claim 1 further comprising:

a base connectable to one of said support tube's upper end.

3. The display tree of claim 1 wherein:

said shelves' top side has a top side recess which is complementary to said upper flanges.

4. The display tree of claim 1 wherein:

said shelves' bottom side has a bottom side recess which is complementary to said lower flanges.

5. The display tree of claim 1 wherein:

said upper flanges have an upper flange bolt hole therethrough.

6. The display tree of claim 1 wherein:

said lower flanges have a lower flange bolt hole therethrough.

7. The display tree of claim 1 wherein:

said shelves have a hole therethrough.

8. The display tree of claim 1 wherein:

said shelf electrical outlet to shelf electrical contact electrical connections are disposed within said shelves.

9. The display tree of claim 1 wherein:

said shelf electrical contacts are located within said shelves' bottom side recess to make said shelf electrical contacts inaccessible when said shelves are connected to said lower flanges.

10. The display tree of claim 1 wherein:

said support tubes are comprised of plastic; and said shelves are comprised of plastic.

11. A display tree comprising:

a plurality of support tubes having two opposite ends, an upper end and a lower end;

a plurality of male electrical plugs one of said male electrical plugs connected to each of said support tubes' upper end;

a plurality of upper flanges one of said upper flanges connected to each of said support tubes adjacent to said support tubes' upper end;

a plurality of female electrical sockets one of said female electrical sockets connected to each of said support tubes lower end;

a plurality of lower flanges one of said lower flanges connected to each of said support tubes adjacent to said support tubes' lower end;

a plurality of flange electrical contacts electrically connected to said female electrical sockets, said flange electrical contacts connected to said lower flanges;

a plurality of substantially disc-shaped shelves having two opposite sides, a top side, and a bottom side;

a plurality of shelf electrical contacts connected to each of said shelves' bottom side, said shelf electrical contacts for detachable connection to said flange electrical contacts;

a plurality of shelf electrical outlets connected to each of said shelves' top side, said shelf electrical outlets electrically connected to said shelf electrical contacts; and a base detachably connectable to one of said support tube's upper end.

12. The display tree of claim 11 wherein:

said shelves' top side has a top side recess which is complementary to said upper flanges.

13. The display tree of claim 12 wherein:

said shelves' bottom side ha has a bottom side recess which is complementary to said lower flanges.

14. The display tree of claim 13 wherein:

said upper flanges have an upper flange bolt hole therethrough.

15. The display tree of claim 14 wherein:

said lower flanges have a lower flange bolt hole therethrough.

16. The display tree of claim 15 wherein:

said shelves have a hole therethrough.

17. The display tree of claim 16 wherein:

said shelf electrical outlet to shelf electrical contact electrical connections being disposed within said shelves.

18. The display tree of claim 17 wherein:

said shelf electrical contacts are located within said shells' bottom side recess to make said shelf electrical contacts inaccessible when said shelves are connected to said lower flanges.

19. The display tree of claim 18 wherein:

said support tubes are comprised of plastic; and said shelves are comprised of plastic.

20. A display tree comprising:

a plurality of support tubes having two opposite ends, an upper end and a lower end, wherein said support tubes are comprised of plastic;

a plurality of male electrical plugs one of said male electrical plugs connected to each of said support tubes' upper end;

plurality of upper flanges one of said upper flanges connected to each of said support tubes adjacent to said support tubes' upper end, wherein said upper flanges have an upper flange bolt hole therethrough;

a plurality of female electrical sockets one of said female electrical sockets connected to each of said support tubes' lower end;

a plurality of lower flanges one of said lower flanges connected to each of said support tubes adjacent to said support tubes' lower end, wherein said lower flanges have a lower flange bolt hole therethrough;

a plurality of flange electrical contacts electrically connected to said female electrical sockets, wherein said flange electrical contacts are connected to said lower flanges;

a plurality of substantially disc-shaped shelves having two opposite sides, a top side and a bottom side, wherein said shelves' top side has a top side recess which is complementary to said upper flanges, and wherein said shelves' bottom side has a bottom side recess which is complementary to said lower flanges, wherein said shelves have a hole therethrough, and wherein said shelves are comprised of plastic;

a plurality of shelf electrical contacts connected to said shells' bottom side, said shelf electrical contacts for detachable connection to said flange electrical contacts, said shelf electrical contacts being located within said shelves' bottom side recess to make said shelf electrical contacts inaccessible when said shelves are connected to said lower flanges;

a plurality of shelf electrical outlets connected to said shelves' top side, wherein said shelf electrical outlets are electrically connected to said shelf electrical contacts, and wherein said shelf electrical outlet to shelf electrical contact electrical connections are disposed within said shelves; and a base detachably connectable to one of said support tube's upper end.

* * * * *